United States Patent [19]

Caudill et al.

[11] 4,152,187

[45] May 1, 1979

[54] METHOD OF SEALING A VACUUM INDUCTION FURNACE

[75] Inventors: Maurice L. Caudill, Peoria; Merle D. Lee, Washington, both of Ill.

[73] Assignee: Caterpillar Tractor Co., Peoria, Ill.

[21] Appl. No.: 823,906

[22] Filed: Aug. 12, 1977

[51] Int. Cl.[2] ..... H05B 5/12

[52] U.S. Cl. ..... 156/187; 13/27; 156/242; 156/278; 156/298; 428/247; 428/261; 428/262; 428/36

[58] Field of Search ..... 156/242, 280, 309, 329, 156/278, 187, 185, 298; 428/246, 247, 261, 262, 369, 371, 440, 447, 448, 450, 465, DIG. 906, 36; 29/605, 606; 13/27

[56] References Cited

U.S. PATENT DOCUMENTS

| | | | |
|---|---|---|---|
| 1,929,368 | 10/1933 | Snell et al. | 428/247 |
| 1,962,682 | 6/1934 | Case | 428/261 |
| 2,010,871 | 8/1935 | Madge et al. | 156/278 |
| 2,653,118 | 9/1953 | Seymour | 428/247 |
| 2,718,483 | 9/1955 | Clark | 428/246 |
| 3,024,153 | 3/1962 | Kennedy | 156/187 |
| 3,056,847 | 10/1962 | Junker | 13/27 |
| 3,667,993 | 6/1972 | Stevenson | 156/329 |
| 3,687,765 | 8/1972 | MacLean et al. | 156/187 |
| 3,979,818 | 9/1976 | Groch et al. | 156/187 |
| 4,011,354 | 3/1977 | Drostholm et al. | 156/298 |
| 4,054,478 | 10/1977 | Linnon | 156/242 |

OTHER PUBLICATIONS

Kirk-Othmer-Encyclopedia . . . Technology, John Wiley & Sons, Inc., vol. 9, p. 159 (1966).

*Primary Examiner*—Jerome W. Massie

*Attorney, Agent, or Firm*—Wegner, Stellman, McCord, Wiles & Wood

[57] ABSTRACT

A vacuum induction furnace including a crucible, a gas-impervious vessel at least partially surrounding the crucible and including sealable means for obtaining access to the crucible, an electrical current-carrying coil assembly surrounding the remainder of the crucible and sealed to the vessel, the coil assembly having coolant-carrying passages and an interior surface confronting the crucible. The surface is defined by plural interfaces of electrically conducting coils and interposed electrical insulators spacing the coils and having irregularities therein. A seal seals the interior surface of the assembly and includes a layer of gas-impervious, elastomeric material reinforced by a nonelectrically conducting reinforcing matrix embedded in the layer, the elastomeric material of the layer being bonded to the coils and insulators and filling the irregularities therein. A layer of heat insulating material is interposed between the crucible and the seal. Also disclosed is a method of sealing the coil assembly.

3 Claims, 3 Drawing Figures

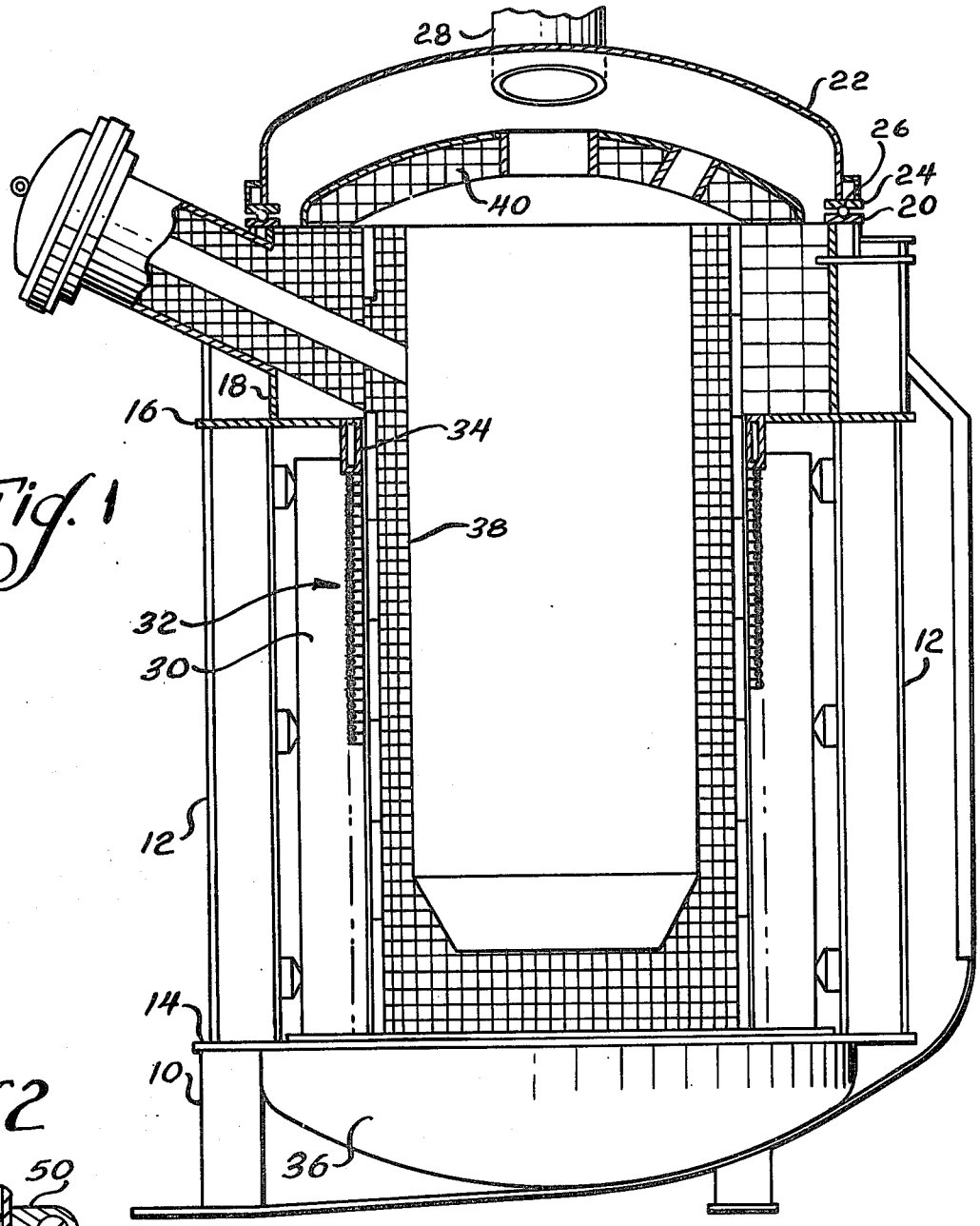
Fig. 1
Fig. 2
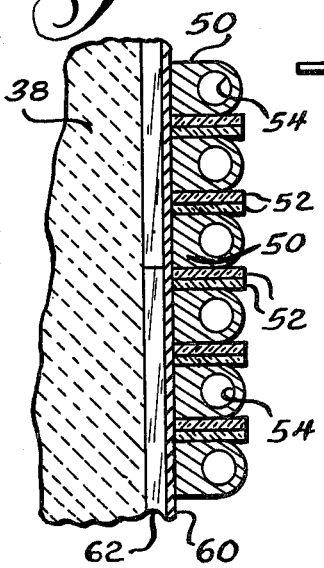
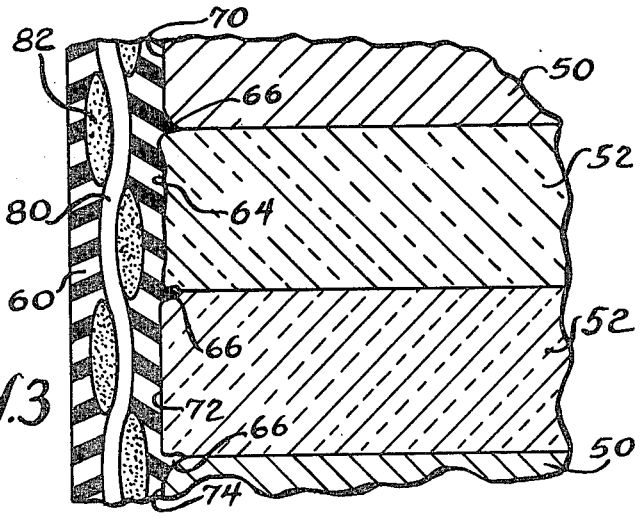
Fig. 3

METHOD OF SEALING A VACUUM INDUCTION FURNACE

BACKGROUND OF THE INVENTION

This invention relates to induction furnaces and, more specifically, to vacuum induction furnaces.

Many attempts have been made to construct a long-lived vacuum induction furnace which have generally proved to be unsuccessful. In the typical furnace, a crucible is partially surrounded by a pressure vessel and the remainder of the crucible is surrounded by a coil assembly which is sealed to the pressure vessel. Typically, the coil assembly is defined by a plurality of spaced, electrically conducting coils which are provided with coolant passages and insulators are interposed between adjacent convolutions of the coils. The resulting interior surface of the coil assembly which confronts the crucible will have many irregularities therein due to inability to obtain precise alignment of the coils about a desired axis and due to irregularities in the surfaces of the components, particularly the insulators. Because the crucibles typically used in such furnaces are somewhat porous, the application of a vacuum to the interior of the vessel will tend to pull air through the crucible from the vicinity of the coil assembly. And, because the coil assembly is formed of multiple coil convolutions and multiple insulators, air can pass through the coil to ultimately be drawn into the crucible. Consequently, either extraordinarily large vacuum pumps have been required or desirable high vacuums cannot be obtained.

It has been proposed to solve the problem by sealing the interior surface of the coil assembly by applying thereto a fiber-reinforced rubber which is vulcanized to the interior surface of the coil. While such a seal will perform its intended function for a short period of time, longevity of seal life is well below that desired.

In particular, when the vacuum is applied to the interior of the vessel, it will tend to draw the seal towards the crucible. Because the interior surface of the coil assembly to which the seal is vulcanized has many irregularities therein, poor bonding is present and, as a result, the seal will be drawn away from the interior surface of the coil assembly and spaced therefrom. The resulting lack of intimate contact with the coil assembly precludes cooling of the seal by the coolant carried in the coolant conduits in the coils with the consequence that the seal overheats and soon fails.

SUMMARY OF THE INVENTION

The present invention is directed to overcoming one or more of the above problems.

According to the present invention, there is provided a vacuum induction furnace including a crucible and a gas-impervious vessel at least partially surrounding the crucible and including sealable means for obtaining access to the crucible. An electrical current-carrying coil assembly surrounds the remainder of the crucible and is sealed to the vessel. The coil assembly has coolant-carrying passages and an interior surface confronting the crucible, the interior surface being defined by plural interfaces of electrical conducting coil and interposed electrical insulators spacing the coils and having irregularities therein. A seal seals the interior surface of the coil assembly and comprises a layer of gas-impervious, elastomeric material reinforced by a nonelectrically conducting reinforcing matrix embedded in the layer. The elastomeric material of the layer is bonded to the coils and the insulators and fills the irregularities therein. A layer of heat insulating material is interposed between the crucible and the seal.

Another facet of the invention contemplates a method of sealing the coils of an induction furnace and comprises the steps of applying a first layer of elastomeric sealing material in a liquid or tacky state to the coils, depositing a reinforcing matrix on the first layer to embed the matrix into the first layer, and thereafter applying a second layer of elastomeric sealing material in a liquid state to the matrix. The first layer achieves excellent bonding to the coil and fills any irregularities in the surface of the coils and the insulators separating the same.

Other objects and advantages will become apparent from the following specification taken in connection with the accompanying drawings.

DESCRIPTION OF THE DRAWINGS

FIG. 1 is a side elevation of a vacuum induction furnace made according to the invention with parts broken away for clarity;

FIG. 2 is an enlarged, fragmentary, sectional view of part of a coil assembly and adjacent furnace components; and FIG. 3 is a greatly enlarged view of part of the coil assembly with a seal disposed thereon.

DESCRIPTION OF THE PREFERRED EMBODIMENT

An exemplary embodiment of a vacuum induction furnace made according to the invention is illustrated in FIG. 1 and is seen to include a base 10 mounting a plurality of upstanding I-beams 12. The I-beams 12 extend upwardly from a flange 14 to mount a flange 16. A cylindrical sleeve 18 is secured to the flange 16 in sealed relation thereto and terminates at its upper surface in a horizontal lip 20. A dome-shaped lip 22 has a lip 24 on its lower edge and a seal 26 is interposed between the lips 20 and 24. A conduit 28 extends to the interior of the lid 22 and may be connected to a vacuum pump or the like.

The base 10 also supports an upstanding bar structure 30 of conventional construction which supports a generally cylindrical, electrical, current-carrying coil assembly, generally designated 32. The coil assembly 32 extends between a generally circular box beam 34 which is sealed to the radially inner edge of the flange 16 by conventional means and a similar box beam (not shown) similarly sealingly engages the periphery of an interior opening in the flange 14. An upwardly open, domed element 36 is sealed to the flange 14 as by welding.

Disposed within the coil assembly 32 is a crucible 38 of conventional construction adapted to receive a material to be heated in the furnace. A splash lid 40 may be disposed on the upper end of the crucible 38 to prevent molten material within the crucible 38 from splashing against the interior surface of the lid 22.

As seen in FIG. 2, the coil assembly 32 comprises a plurality of coils 50 separated by strips of mica insulation 52. Each of the coils 50 includes a coolant conduit 54. In general, the arrangement of the coils 50, the mica strips 52, and the conduits 54 will be conventional and form no part of the present invention.

The interior surface of the coil assembly 32 confronts the crucible 38, as seen in FIG. 2, and has a seal 60 made according to the present invention bonded thereto. A layer of insulating material 62 is interposed between the outer surface of the crucible 38 and the seal 60 to minimize heat flow to the seal 60 from the crucible.

As seen in FIG. 3, the radially inner surface 64 of at least some of the mica strips 52 is irregular and irregularities such as those shown at 66 will typically exist at the interfaces between the mica strips 52 and the coils 50. Moreover, because absolute concentricity of the inner surfaces of the coils 50 and the mica strips 52 about the cylindrical axis of the assembly 32 is extremely difficult to obtain, it will be seen that the radially inner surface 70 of the uppermost coil 50 is located somewhat radially outwardly of the radially inner surfaces 72 and 74 of the lowermost mica strip 52 and the lowermost coil 50, respectively.

The seal 60 is in the form of a thin layer, typically on the order of 0.050 inches thick, of an elastomeric sealing material. In a preferred embodiment, the elastomeric material used will be a temperature resistant silicone rubber. Embedded in the seal 60 is a reinforcing matrix 80 to provide tensile strength to the seal 60. In a preferred embodiment, the matrix 80 is formed of a nonelectrically conducting material and, preferably, is fibrous in nature. As illustrated, it is in the form of a closely woven, glass fiber cloth with the individual strands 82 thereof being compressed into an oval shape from the normal cylindrical configuration. It will be observed that the elastomeric material substantially completely fills the irregularities 64 and 66 in the inner surface of the coil assembly 32 and is bonded thereto so that when the contents of the furnace are subjected to a vacuum, the seal 60 will not pull away from the insulating strips 52 or the coils 50 and will continue to be cooled by direct heat transfer to the coils 50 which are, in turn, cooled by coolant flowing through the conduits 54.

Those skilled in the art will appreciate that if only a slight separation occurs between the seal 60 and the coils 50, the seal will be insulated by the resulting gap from the coolant and will receive some measure of heat through the insulating layer 62 from the crucible 38. When such occurs, the seal 60 will fail due to overheating. The present invention overcomes the problem by providing a good bond and the filling of the irregularities in the interior surface of the coil assembly 32.

The method by which the seal 60 is formed is as follows. First, a layer of elastomeric material which is to comprise the seal is applied to the surface of the coil assembly 32 to be sealed in a liquid or tacky state. Preferably, the first layer is applied with a scraping action and, in general, it is preferred that the layer be at least 0.010 inches thick. A fiberglass cloth is then placed on the first layer and rolled into the same to become partly embedded in the first layer. Thereafter, a second layer of the elastomeric material, also in a tacky or liquid state, is applied to the matrix defined by the fiberglass cloth. Because the first layer is applied in a liquid or tacky state, it readily flows into the irregularities in the interior surface of the coil assembly 32 and actually wets the surface thereof to achieve a good bond. The matrix 80 provides strength against the tensile forces exerted by a vacuum and the second layer applied to the matrix 80 ensures that there are no gaps in the seal.

The use of the aforementioned scraping action during the application of the elastomeric layers assures not only that the irregularities in the interior surface of the coil assembly 32 are filled, but that the second layer thoroughly wets and covers and bonds and adheres to the fibers and the yarn strands of the fiberglass reinforcing matrix 80.

Preferably, when the seal 60 is applied, it is applied beyond the ends of the coil assembly 32 and onto the box beam 34 to sealingly engage the same as well. The same approach is carried out with the lower box beam (not shown) adjacent the lower flange 34. Since such box beams are sealed to vessel components, including the lid 22, the sleeve 18 and the upwardly opening dome 36, and the seal thoroughly seals the coil assembly 32 which, together with the vessel, completely surround the crucible 38, an airtight furnace is provided.

the tensile strength provided to the seal 60 by the matrix 80 prevents the elastomeric layers of the seal 60 from stretching. Consequently, bubbles therein cannot form with the result that there is no stretching and bending at the base of a bubble to overcome the strength of the bond. Thus, the seal 60 has a long life as mentioned previously.

The embodiments of the invention in which an exclusive property or privilege is claimed are defined as follows:

1. A method of sealing the coils of an induction furnace having a crucible surrounded by a plurality of electrical current-carrying coils, comprising the steps of:

(a) applying a first layer of elastomeric sealing material in a liquid state to the coils;
(b) depositing a reinforcing matrix on the first layer;
(c) working the matrix into the first layer; and
(d) applying a second layer of elastomeric sealing material in a liquid state to the matrix.

2. A method of sealing the interior surface of a generally cylindrical, electrical current-carrying coil assembly adapted to receive an induction furnace crucible comprising the steps of:

(a) spreading with a scraping action a first layer of a tacky elastomeric sealing material on said interior surface;
(b) applying a nonelectrically conducting fibrous material to the first layer such that it is partially embedded therein; and
(c) spreading a second layer of tacky elastomeric sealing material on said matrix.

3. The method of claim 2 wherein step (b) is performed by rolling a cloth-like matrix into said first layer.

* * * * *